US012630960B2

(12) United States Patent
Xue et al.

(10) Patent No.: US 12,630,960 B2
(45) Date of Patent: May 19, 2026

(54) INNER TUB FOR CLOTHES TREATING APPARATUS AND CLOTHES TREATING APPARATUS

(71) Applicant: WUXI LITTLE SWAN ELECTRIC CO., LTD., Wuxi (CN)

(72) Inventors: Erpeng Xue, Wuxi (CN); Wei Zhou, Wuxi (CN); Jia Wang, Wuxi (CN); Hong Seok Ko, Wuxi (CN); Weiguo Yang, Wuxi (CN); Fei Kang, Wuxi (CN); Youming Tu, Wuxi (CN); Shuai Tong, Wuxi (CN); Shicheng Li, Wuxi (CN)

(73) Assignee: WUXI LITTLE SWAN ELECTRIC CO., LTD., Wuxi (CN)

( * ) Notice: Subject to any disclaimer, the term of this patent is extended or adjusted under 35 U.S.C. 154(b) by 0 days.

(21) Appl. No.: 17/927,730

(22) PCT Filed: Apr. 29, 2022

(86) PCT No.: PCT/CN2022/090708
§ 371 (c)(1),
(2) Date: May 4, 2023

(87) PCT Pub. No.: WO2023/071132
PCT Pub. Date: May 4, 2023

(65) Prior Publication Data

US 2024/0229325 A1 Jul. 11, 2024

(30) Foreign Application Priority Data

Nov. 1, 2021 (CN) ..... 202122649900.7
Mar. 31, 2022 (CN) ..... 202210346381.3
(Continued)

(51) Int. Cl.
*D06F 37/06* (2006.01)
*D06F 58/04* (2006.01)

(52) U.S. Cl.
CPC ..... *D06F 37/065* (2013.01); *D06F 58/04* (2013.01)

(58) Field of Classification Search
CPC ..... D06F 37/02; D06F 37/04; D06F 37/06; D06F 37/065
See application file for complete search history.

(56) References Cited

U.S. PATENT DOCUMENTS

2005/0022565 A1* 2/2005 Jung ..... D06F 37/06 68/207
2005/0044899 A1* 3/2005 Reinwald ..... D06F 37/04 68/58
(Continued)

FOREIGN PATENT DOCUMENTS

CN 101429717 A 5/2009
CN 203420126 U 2/2014
(Continued)

OTHER PUBLICATIONS

Machine Translation of Aring et al., DE-10260023-B3, Jan. 2004. (Year: 2004).*
(Continued)

*Primary Examiner* — David G Cormier
(74) *Attorney, Agent, or Firm* — K&L Gates LLP

(57) ABSTRACT

Provided are an inner tub for a clothes treating apparatus and a clothes treating apparatus. The inner tub includes a tub and a lifting rib. The body includes a bottom and a body. The lifting rib is disposed on an inner side of the body. Drainage holes is defined in a part of the body covered with the lifting rib. The plurality of drainage holes are in a normally open state to communicate an inner side of the tub with an outer side of the tub. The remaining part of the body other than the
(Continued)

part of the body covered with the lifting rib has a closed structure.

17 Claims, 5 Drawing Sheets

(30) Foreign Application Priority Data

Mar. 31, 2022 (CN) ..... 202220766494.4
Mar. 31, 2022 (CN) ..... 202220772607.1

(56) References Cited

U.S. PATENT DOCUMENTS

| | | | | |
|---|---|---|---|---|
| 2005/0097927 | A1* | 5/2005 | Kim | D06F 37/065 68/142 |
| 2015/0027173 | A1 | 1/2015 | Wu et al. | |
| 2017/0191202 | A1* | 7/2017 | Lee | D06F 37/06 |

FOREIGN PATENT DOCUMENTS

| | | | | |
|---|---|---|---|---|
| CN | 205856868 | U | 1/2017 | |
| CN | 107687071 | A | 2/2018 | |
| CN | 109423800 | A | 3/2019 | |
| CN | 113106703 | A | 7/2021 | |
| CN | 213681365 | U | 7/2021 | |
| CN | 213740129 | U | 7/2021 | |
| CN | 113529355 | A | 10/2021 | |
| CN | 217052766 | U | 7/2022 | |
| DE | 10260023 | B3 * | 1/2004 | D06F 37/04 |
| EP | 1433889 | B1 | 11/2006 | |
| EP | 2363523 | A1 | 9/2011 | |
| EP | 3575474 | A1 * | 12/2019 | D06F 37/04 |
| EP | 3875668 | A1 | 9/2021 | |
| GB | 717974 | A | 11/1954 | |
| JP | 2019501000 | A | 1/2019 | |
| KR | 20050114812 | A | 12/2005 | |
| WO | WO-2020130523 | A1 * | 6/2020 | D06F 33/34 |

OTHER PUBLICATIONS

Machine Translation of Fechtel et al., EP-3575474-A1, Dec. 2019. (Year: 2019).*
Machine Translation of Nakanishi et al., WO-2020130523-A1, Jun. 2020. (Year: 2020).*
ISR mailed Aug. 4, 2022 for PCT No. PCT/CN2022/090708.
Extended European Search Report received in EP Application No. 22805745.1; mailed Oct. 25, 2023.
First OA received in JP application No. 2022-573193; mailed Jan. 9, 2024.
The third Office Action received in the counterpart EP application 22805745.1, dated Aug. 18, 2025, 5 pages.
The first Office Action received in the counterpart CN application 202210346381.3, dated Nov. 28, 2024, 9 pages with English translation.
The Rejection Decision received in the counterpart CN application 202210346381.3, dated Mar. 28, 2025, 10 pages with English translation.
The first Office Action received in the counterpart EP application 22805745.1, dated Aug. 14, 2024, 4 pages.
The Rejection Decision received in the counterpart JP application 2022-573193, dated Jul. 30, 2024, 6 pages with English translation.
The ISA Written Opinion received in the counterpart PCT application PCT/CN2022/090708, dated Aug. 4, 2022, 7 pages with English translation.

* cited by examiner

INNER TUB FOR CLOTHES TREATING APPARATUS AND CLOTHES TREATING APPARATUS

CROSS-REFERENCES TO RELATED APPLICATIONS

The present disclosure is a national phase application of International Application No. PCT/CN2022/090708, filed on Apr. 29, 2022, which claims priorities to Chinese Patent Application No. 202122649900.7, filed on Nov. 1, 2021, and Chinese Patent Applications No. 202220766494.4, No. 202210346381.3, and No. 202220772607.1, filed on Mar. 31, 2022, the entireties of which are herein incorporated by reference.

FIELD

The present disclosure relates to the field of clothes treating technologies, and more particularly, to an inner tub for a clothes treating apparatus and a clothes treating apparatus.

BACKGROUND

For a conventional inner tub for a clothes treating apparatus, in order to facilitate rapid discharging of a fluid in the inner tub, a large number of drainage holes are typically defined in a body of the inner tub. However, in a clothes treating process of the clothes treating apparatus, these drainage holes may scratch clothes and cause abrasion of the clothes, which may degrade user experience.

SUMMARY

To this end, the present disclosure provides an inner tub for a clothes treating apparatus. The inner tub can allow a fluid in the inner tub to be discharged while abrasion of clothes due to direct contact of drainage holes with the clothes can be avoid. Thus, user experience can be improved.

The present disclosure further aims to provide a clothes treating apparatus having the inner tub as described above.

According to embodiments of the present disclosure, an inner tub for a clothes treating apparatus is provided. The inner tub includes a tub and a lifting rib. The tub includes a bottom and a body. The lifting rib is disposed on an inner side of the body. Drainage holes are defined in a part of the body covered with the lifting rib. The plurality of drainage holes are in a normally open state to communicate an inner side of the tub with an outer side of the tub. The remaining part of the body other than the part of the body covered with the lifting rib has a closed structure.

With the inner tub for the clothes treating apparatus according to the embodiments of the present disclosure, through forming the plurality of drainage holes on the part of the body covered with the lifting rib, the lifting rib can efficiently enhance clothes treating performance, but also effectively cover the plurality of drainage holes. Thus, it is possible to ensure that the remaining part of the inner side of the body other than the part covered with the lifting rib is formed into the closed structure. In this way, during a clothes treating of the clothes treating apparatus, abrasion of clothes due to direct contact with the plurality of drainage holes can be avoided. Thus, the user experience can be improved. In addition, in the present disclosure, the plurality of drainage holes are in the normally open state, which increases drainage performance on the one hand, and on the other hand, it is unnecessary to provide a seal for each drainage hole. In this way, production costs of the inner tub of the present disclosure can be lowered, and the inner tub has a simple structure. Further, the difficulty of manufacturing can be reduced.

In some embodiments, the body includes first walls and second walls. The plurality of first walls and the plurality of second walls are alternately arranged and connected to each other in a circumferential direction. The plurality of drainage holes are defined in at least one of the plurality of first walls. Lifting ribs are disposed on the plurality of first walls in a one-to-one correspondence to cover all of the plurality of drainage holes. Each of the plurality of second walls has a non-porous structure.

In some embodiments, the body has rows of drainage holes. Each of the plurality of rows of drainage holes includes the plurality of drainage holes, and the plurality of rows of drainage holes are arranged at intervals in a circumferential direction of the body.

In some embodiments, for the plurality of rows of drainage holes, a spacing between any two adjacent rows of drainage holes is equal to a spacing between any other two adjacent rows of drainage holes; and/or for each of the plurality of rows of drainage holes, the plurality of drainage holes are arranged at intervals in an axial direction and/or the circumferential direction of the body.

In some embodiments, the lifting rib extends in an axial direction of the tub. Lifting ribs are disposed on the body, each of the plurality of lifting ribs covering one row of drainage holes on the body.

In some embodiments, an inner wall surface of the body has a concave arc surface, and the plurality of drainage holes are defined in the concave arc surface.

In some embodiments, an inner wall surface of the body has recesses recessed towards an outside of the tub. The plurality of drainage holes are defined in bottom walls of the plurality of recesses.

In some embodiments, a fluid flow channel is defined between the lifting rib and the body or in the lifting rib, and the plurality of drainage holes are in communication with an inner cavity of the tub through the fluid flow channel; and/or the lifting rib has a hollow structure, the body has engagement holes, the lifting rib has engagement hooks disposed at each of two sides of the lifting rib, and the plurality of engagement hooks are engaged with the plurality of engagement holes in a one-to-one correspondence.

According to embodiments of the present disclosure, an inner tub for a clothes treating apparatus is provided. The inner tub includes a tub and a lifting rib. The tub includes a bottom and a body. The body has a drainage region. The lifting rib is disposed on an inner side of the body and covering the drainage region. Rows of drainage holes are defined in the drainage region covered with the lifting rib. Each row of the plurality of rows of drainage holes includes drainage holes. For at least two adjacent rows of the plurality of rows of drainage holes, the plurality of drainage holes of one row of drainage holes are staggered with the respective plurality of drainage holes of the other row of drainage holes in an axial direction of the body.

With the inner tub for the clothes treating apparatus according to the embodiments of the present disclosure, the lifting rib is disposed on the inner side of the body to cover the drainage region. Thus, the plurality of drainage holes can be covered. In such an arrangement, the lifting rib can not only enhance clothes treating performance, but also cover the plurality of drainage holes. In this way, during the clothes treating of the clothes treating apparatus, the abrasion of the clothes due to direct contact with the plurality of drainage holes can be avoided to improve the user experience. In addition, in the present disclosure, the plurality of rows of drainage holes are defined in the drainage region, and for at least two adjacent rows of the plurality of rows of drainage holes, the plurality of drainage holes of one row of drainage holes are staggered with the respective plurality of drainage holes of the other row of drainage holes in an axial direction of the body. Thus, the plurality of drainage holes in the two adjacent rows of the plurality of rows of drainage holes can be located at different positions of the body. In this way, the plurality of drainage holes can cooperate with each other to discharge a fluid located at different positions of the body simultaneously. Thus, the drainage of the inner tub of the clothes treating apparatus is facilitated, and therefore drainage efficiency is improved.

In some embodiments, for any two adjacent rows of the plurality of rows of drainage holes, the plurality of drainage holes of one row of drainage holes are staggered with the respective plurality of drainage holes of the other row of drainage holes in the axial direction of the body.

In some embodiments, for each row of the plurality of rows of drainage holes, a spacing between two adjacent drainage holes of the plurality of drainage holes in the axial direction of the body is H1. For the two adjacent rows of the plurality of rows of drainage holes, a spacing between one of the plurality of drainage holes in one row of drainage holes and a drainage hole, adjacent to the one drainage hole, in the other row of drainage holes is H2, where H1 is twice as great as H2.

In some embodiments, a spacing between the two adjacent rows of the plurality of rows of drainage holes in a circumferential direction of the body is equal to a spacing between two adjacent drainage holes in each row of the plurality of rows of drainage holes in the axial direction of the body.

In some embodiments, fluid flowing-through openings are defined in a lower part of at least one side wall of the lifting rib. A fluid flow channel is defined by the plurality of fluid flowing-through openings together with the body. Each of the plurality of fluid flowing-through openings is located at a position corresponding to at least one of the plurality of drainage holes.

In some embodiments, drainage regions is provided, and the plurality of drainage regions is arranged at intervals in a circumferential direction of the body.

In some embodiments, an inner peripheral wall of the body has a rubbing region, the rubbing region is a non-porous region, the rubbing region and the drainage region are arranged in a circumferential direction of the body, and the rubbing region has rubbing protrusions arranged at intervals in the circumferential direction of the body; and/or flow guide channels are each defined between two adjacent rubbing protrusions of the plurality of rubbing protrusions, and an end of each of at least some of the plurality of flow guide channels directly face the respective drainage region.

According to embodiments of the present disclosure, a clothes treating apparatus is provided. The clothes treating apparatus includes an outer tub, and the inner tub for the clothes treating apparatus as described above. The inner tub is rotatably disposed in the outer tub.

With the clothes treating apparatus according to the embodiment of the present disclosure, by using the above-mentioned inner tub for the clothes treating apparatus, it is possible to effectively reduce abrasion of the clothes by the clothes treating apparatus during clothes treating, and thus user experience can be effectively improved.

BRIEF DESCRIPTION OF THE DRAWINGS

The above and/or additional embodiments of the present disclosure will become more apparent and understandable from the following description of embodiments taken in conjunction with the accompanying drawings.

REFERENCE NUMERALS IN THE ACCOMPANYING DRAWINGS

Figure 1:
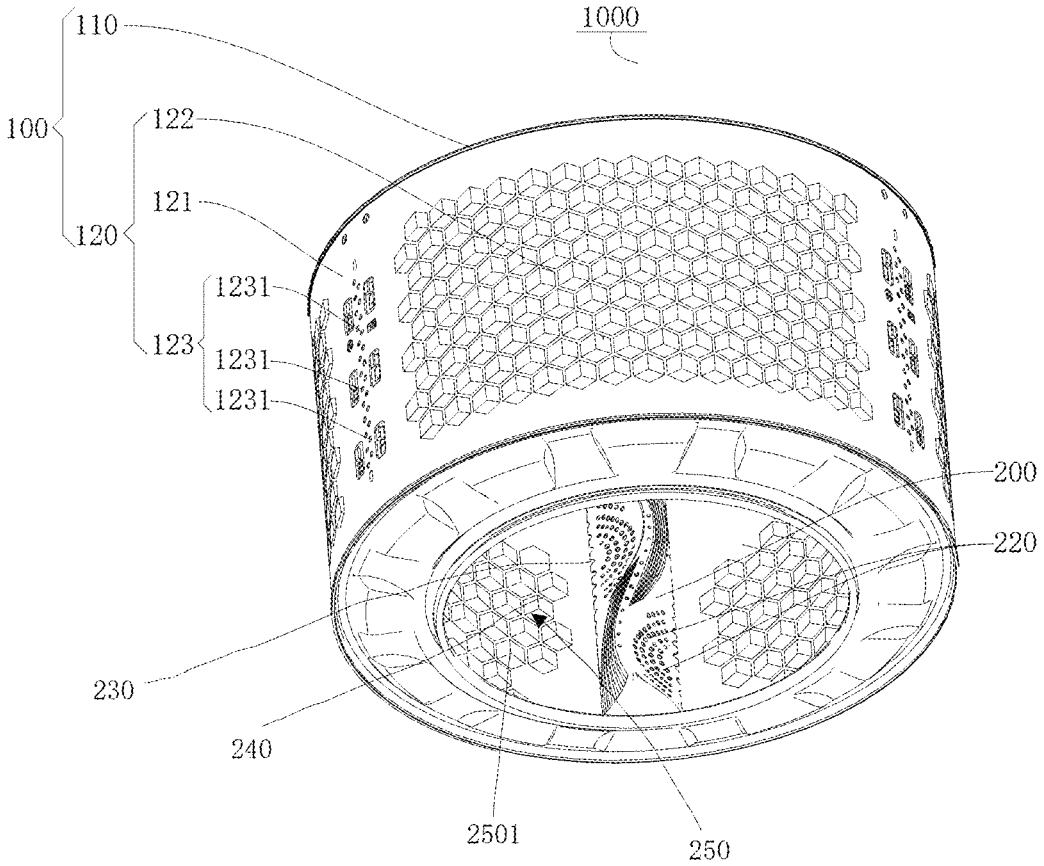
FIG. 1 is a schematic perspective structural view of an inner tub according to some embodiments of the present disclosure.

1000, inner tub;
100, tub;
110, bottom;
120, body;
121, first tub wall; 122, second tub wall; 123, row of drainage holes; 1231, drainage hole; 124, drainage region;
200, lifting rib; 210, engagement hook; 220, fluid flow inlet; 230, fluid flowing-through opening; 240, flow guide channel; 250, rubbing region; 2501, rubbing protrustion;
2000, clothes treating apparatus.

DETAILED DESCRIPTION OF THE DISCLOSURE

Embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the accompanying drawings are illustrative only, and are intended to explain, rather than limiting, the present disclosure.

In the description of the present disclosure, it should be understood that the orientation or position relationship indicated by the terms "upper", "lower", "top", "bottom", "inner", "outer", "axial", "radial", "circumferential" etc., is based on the orientation or position relationship shown in the drawings, and is only for the convenience of describing the present disclosure and simplifying the description, rather than indicating or implying that the associated device or element must have a specific orientation, or be constructed and operated in a specific orientation, and therefore cannot be understood as a limitation on the present disclosure.

An inner tub 1000 for a clothes treating apparatus according to embodiments of the present disclosure will be described below with reference to the accompanying drawings.

As illustrated in FIG. 1, the inner tub 1000 for the clothes treating apparatus according to the embodiments of the present disclosure includes a tub 100 and a lifting rib 200.

The tub 100 includes a body 120 and a bottom 110. The lifting rib 200 is disposed on an inner side of the body 120. Drainage holes 1231 are defined in a part of the body 120 covered with at least one lifting rib 200. The plurality of drainage holes 1231 are in a normally open state. Thus, an inner side of the tub 100 and an outer side of the tub 100 are always in communication with each other through the plurality of drainage holes 1231. The remaining part of the body 120 other than the part covered with the lifting rib 200 has a closed structure.

In a washing process of the clothes treating apparatus, with a rotation of the tub 100, the lifting rib 200 can drive clothes to rotate. In this way, on the one hand, a level of the clothes can be increased by the lifting rib 200 and the clothes fall down due to gravity. In this way, the clothes can be thrown and rolled in an up-down direction for clothes treating. On the other hand, a contact area between the clothes and the inner tub 1000 can be increased by the lifting rib 200. Thus, it is possible to generate rubbing effect by mutual friction between the clothes close to the lifting rib 200 and the lifting rib 200. Therefore, clothes treating capacity of the inner tub 1000 can be improved to enhance user experience.

Through forming the plurality of drainage holes 1231 on the body 120, the plurality of drainage holes 1231 can communicate the inner tub 1000 with an external flow path. Thus, it is possible to ensure that a fluid in the inner tub 1000 can be discharged smoothly through the plurality of drainage holes 1231 to achieve the clothes treating. In addition, the plurality of drainage holes 1231 cooperate with each other for simultaneous drainage. Thus, drainage efficiency is improved. Meanwhile, washing water and dirt are completely discharged, which in turn further improves the clothes treating capacity of the inner tub 1000.

With the inner tub 1000 for the clothes treating apparatus according to the embodiments of the present disclosure, by forming the plurality of drainage holes 1231 on the part of the body 120 covered with the lifting rib 200, it is possible to cover the plurality of drainage holes 1231 with a structure on the inner tub 1000 without other structural members for covering the plurality of drainage holes 1231. Thus, the inner tub 1000 is simplified in structure. Further, it is possible to ensure that the remaining part of inner side of the body 120 other than the part covered with the lifting rib 200 is formed into the closed structure. In this way, in the clothes treating process, the plurality of drainage holes 1231 are in no direct contact with the clothes, which can avoid abrasion of the clothes by edges of the plurality of drainage holes 1231. Thus, abrasion of the clothes can be effectively alleviated. Therefore, an abrasion rate of the clothes can be greatly lowered to improve the user experience.

Further, the plurality of drainage holes 1231 are in the normally open state to enable the inner side of the tub 100 and the outer side of the tub 100 to be communicated with each other through the plurality of drainage holes 1231. Thus, the drainage efficiency can be improved. Further, the washing water and dirt inside the inner tub 1000 can be completely discharged. Thus, drainage performance can be improved, which in turn improve the clothes treating capacity of the inner tub 1000. In addition, it is not necessary to provide a seal for sealing the plurality of drainage holes 1231 at the plurality of drainage holes 1231, which can lower production costs of the inner tub 1000 of the present disclosure, and reduce the manufacturing difficulty while simplify the structure of the inner tub 1000 for easy control.

It should be understood that, compared with an inner tub for a clothes treating apparatus in the related art, for the inner tub 1000 for the clothes treating apparatus according to the embodiments of the present disclosure, the plurality of drainage holes 1231 are formed on the part of the body 120 covered with the lifting rib 200. Thus, it is possible to ensure that the plurality of drainage holes 1231 would not be brought into direct contact with the clothes during the clothes treating of the clothes treating apparatus to prevent the clothes from being snagged or scratched by the plurality of drainage holes 1231. Therefore, the user experience can be improved. In addition, the plurality of drainage holes 1231 in the normally open state can communicate the inner side of the tub 100 with the outer side of the tub 100. Thus, it is possible to ensure that a fluid flow in the tub 100 can be discharged timely and completely while simplifying the structure of the inner tub.

In the description of the present disclosure, unless otherwise specified, "plurality" means two or more.

Figure 2:
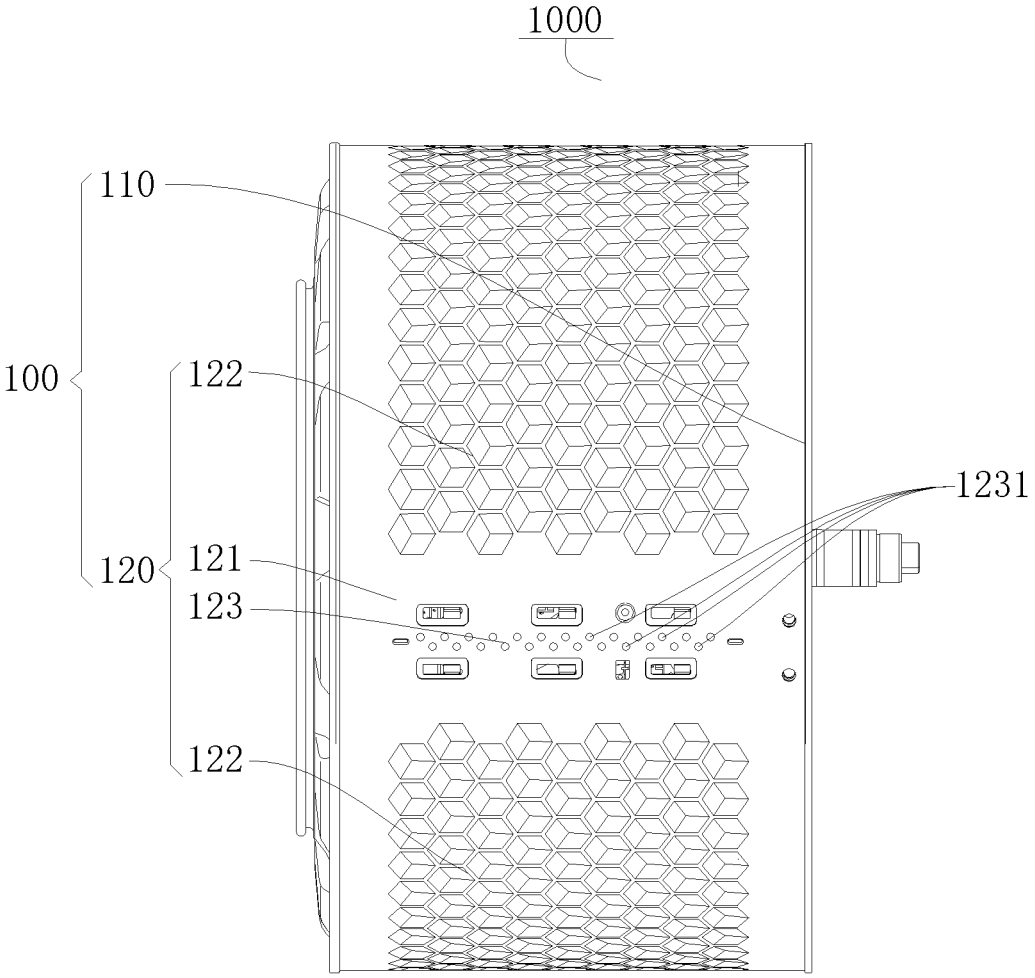
FIG. 2 is a side view of an inner tub according to some embodiments of the present disclosure.

In some embodiments of the present disclosure, as illustrated in FIG. 1 and FIG. 2, the body 120 includes first walls 121 and second walls 122. The plurality of first walls 121 and the plurality of second walls 122 are alternately arranged and connected to each other in a circumferential direction. That is, in a circumferential direction of the body 120, one second tub wall 122 is disposed between any two adjacent first walls 121, and one first tub wall 121 is disposed between any two adjacent second walls 122.

The plurality of drainage holes 1231 are formed in at least one of the plurality of first walls 121. Lifting ribs 200 are disposed on the plurality of first walls 121 in a one-to-one correspondence to cover all of the drainage holes 1231. The first tub wall 121 can provide a space for the arrangements of the plurality of drainage holes 1231 and the plurality of lifting ribs 200. Thus, it is possible to ensure that the plurality of lifting ribs 200 can be disposed on the body 120. Further, it is also possible to ensure that the plurality of lifting ribs 200 can be arranged to correspond to the plurality of drainage holes 1231 to cover the plurality of drainage holes 1231. Thus, it is possible to prevent the clothes from being snagged or scratched by the plurality of drainage holes 1231 due to the contact of the plurality of drainage holes 1231 with the clothes. Thus, the user experience can be improved.

In some embodiments, each of the plurality of second walls 122 is a non-porous structure. Since the second tub wall 122 is in direct contact with the clothes in the clothes treating process, this non-porous structure of the second tub wall 122 can prevent the clothes from being scratched by the second tub wall 122.

In some embodiments, as illustrated in FIG. 1 and FIG. 2, the plurality of second walls 122 has concave-convex patterns. These patterns can provide greater frictional resistance to the clothes during the clothes treating to allow the body 120 itself to have a rubbing function. Therefore, the clothes can be treated more cleanly to improve the user experience.

It should be noted that since the concave-convex patterns are disposed on each of the plurality of second walls 122, arranging the lifting rib 200 on the plurality of first walls 121 can further ensure that the lifting rib 200 would not cover the concave-convex patterns. Thus, all of the patterns formed on the body 120 can effectively function.

In some embodiments of the present disclosure, as illustrated in FIG. 1, the body 120 has rows of drainage holes 123. Each row of drainage holes 123 includes the plurality of drainage holes 1231. The plurality of rows of drainage holes 123 are arranged at intervals in the circumferential direction of the body 120.

Therefore, through providing the plurality of rows of drainage holes 123, an amount of the drainage holes 1231 in the body 120 can be increased to enhance drainage capacity of the inner tub 1000 and improve the drainage efficiency. In addition, the plurality of rows of drainage holes 123 are arranged at intervals in the circumferential direction of the body 120, allowing the fluid flow at several positions in the inner tub 1000 to be discharged through the drainage holes 1231 simultaneously, which can further improve the drainage efficiency. In some embodiments, in a process of dewatering using the inner tub 1000, the plurality of rows of drainage holes 123 cooperate with each other, which can greatly improve dewatering quality to reduce a moisture content of the clothes.

In some embodiments, in the plurality of rows of drainage holes 123, a spacing between any two adjacent rows of drainage holes 123 is equal to a spacing between any other two adjacent rows of drainage holes 123. That is, the plurality of rows of drainage holes 123 are arranged at intervals in the circumferential direction of the body 120. The plurality of rows of drainage holes 123 cooperate with each other to simultaneously discharge the fluid flow out of the inner tub 1000. Thus, the drainage efficiency can be further improved.

In some embodiments, for each row of drainage holes 123, the plurality of drainage holes 1231 are arranged at intervals in an axial direction of the body 120. In such an arrangement, the plurality of drainage holes 1231 can cooperate with each other to discharge the fluid flow at different positions in the axial direction of the body 120. Thus, the drainage efficiency can be improved.

In other examples, for each row of drainage holes 123, the plurality of drainage holes 1231 are arranged at intervals in the circumferential direction of the body 120. The plurality of drainage holes 1231 can cooperate with each other to discharge the fluid flow at different positions in the circumferential direction of the body 120. Thus, the drainage efficiency can be improved.

In some other examples, as illustrated in FIG. 1 and FIG. 2, for each row of drainage holes 123, the plurality of drainage holes 1231 are arranged at intervals in the axial direction and the circumferential direction of the body 120.

That is, the plurality of drainage holes 1231 are arranged at intervals not only in the axial direction of the body 120 but also in the circumferential direction of the body 120. Thus, an amount of the drainage holes 1231 can be increased, allowing each row of drainage holes 123 to discharge the fluid flow at different positions in both the axial direction and the circumferential direction of the body 120. Thus, the drainage efficiency can be further improved.

In some embodiments, the body 120 has three rows of drainage holes 123. The three rows of drainage holes 123 are evenly distributed on the body 120, and cooperate with each other to discharge the fluid flow in the inner tub 1000 for the dewatering. Thus, dewatering efficiency can be improved.

In some other examples, the present disclosure is not limited to the above-mentioned three rows of drainage holes 123. Some embodiments may provide more rows of drainage holes 123 based on actual drainage demands and a volume of the inner tub 1000. For example, four, five, or more rows of drainage holes 123 may be provided.

It should be noted that an increase in the amount of the row of drainage holes 123 may result in a decrease in structural strength of the body 120. Therefore, arranging the three rows of drainage holes 123 can effectively improve the structural strength of the body 120 while increasing the drainage efficiency. Thus, a service life of the inner tub 1000 can be prolonged.

In some embodiments, as illustrated in FIG. 1, the lifting rib 200 extends in the axial direction of the tub 100 to increase an area of the lifting rib 200. Thus, it is possible to ensure that the lifting rib 200 can effectively drive the clothes to rotate and increase a contact area between the inner tub 1000 and the clothes. Thus, the clothes can be treated, cleanliness of the clothes treating can be improved.

Figure 3:
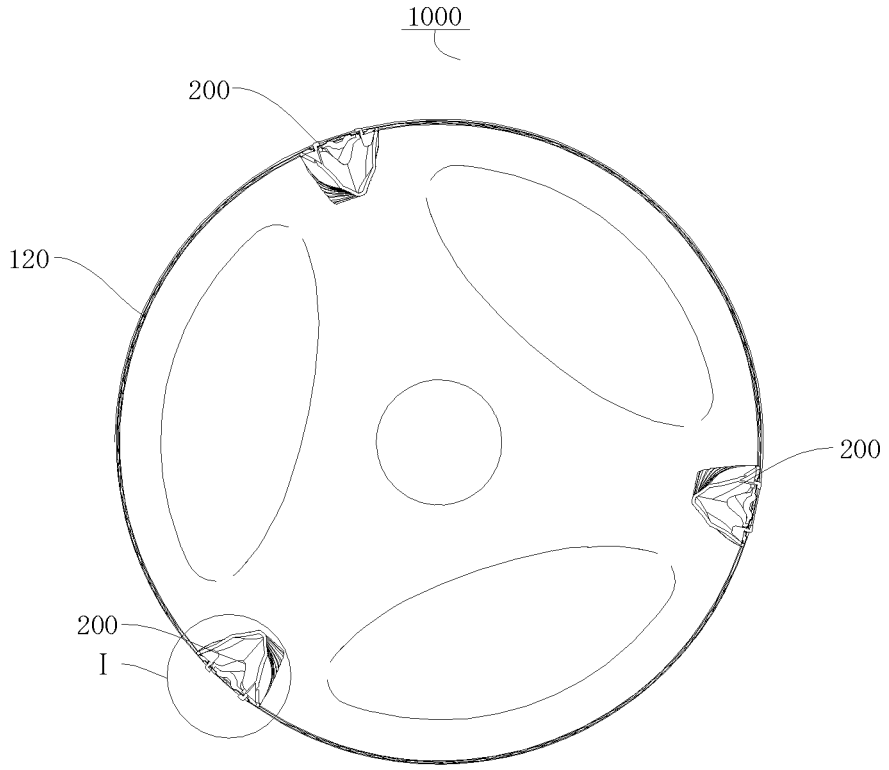
FIG. 3 is a front view of an inner tub according to some embodiments of the present disclosure.

In some embodiments, with reference to FIG. 1 and FIG. 3, the body 120 has lifting ribs 200. Each lifting rib 200 may cover one row of drainage holes 123 on the body 120. The plurality of lifting ribs 200 cooperate with each other to further increase the contact area between the inner tub 1000 and the clothes and improve the cleanliness of the clothes treating. In addition, since the plurality of lifting ribs 200 are provided, rows of drainage holes 123 may be provided accordingly to form the plurality of rows of drainage holes 123 on the body 120. Thus, the fluid flow in the inner tub 1000 can be discharged effectively to improve the drainage efficiency. Further, the cleanliness of the clothes treating can be improved.

In some specific examples, as illustrated in FIG. 1, the body 120 is provided with three lifting ribs 200. The three lifting ribs 200 are evenly distributed on the inner wall of the inner tub 1000 to cover the row of drainage holes 123. When the clothes treating apparatus is in operation, the lifting ribs 200 may rotate along with the inner tub 1000. During a rotation of the lifting ribs 200 from a lower level to a higher level, the lifting ribs 200 may lift the clothes. As the lifting ribs 200 continue rotating, the clothes can move away from the lifting ribs 200 due to the gravity, and fall down freely to be thrown on the tumbling fluid flow or other clothes. Therefore, the clothes can be cleaned, and cleaning performance of the clothes treating apparatus can be improved.

In some other examples, the present disclosure is not limited to the above-mentioned three lifting ribs 200, as long as the amount of lifting ribs 200 can correspond to the amount of the row of drainage holes 123 and the lifting rib 200 can effectively cover the drainage holes 1231.

In some embodiments of the present disclosure, an inner wall surface of the body 120 has a concave arc surface. That is, taking a cylindrical surface where the inner wall surface of the body 120 is located as a reference surface, the concave arc surface is disposed in a direction away from the cylindrical surface to locate the concave arc surface at an outer side of the cylindrical surface.

The plurality of drainage holes 1231 are defined in the concave arc surface. It should be understood that the plurality of drainage holes 1231 are located at a lower level than the cylindrical surface in a radial direction of the body 120. In this way, during a process of drainage or dewatering of the clothes treating apparatus, such an arrangement is conducive to a flow of the fluid towards the plurality of drainage holes 1231, which in turn improves the drainage efficiency of the clothes treating apparatus. Thus, the dewatering quality can be improved.

In some embodiments of the present disclosure, the inner wall surface of the body 120 has recesses recessed towards an outside of the tub 100. Each recess may have a bottom wall and a side wall. Taking the cylindrical surface where the inner wall surface of the body 120 is located as the reference surface, the bottom wall of the recess is lower than the cylindrical surface, and the plurality of drainage holes 1231 are defined in the bottom wall of the recess. A wall surface of the recess may also be formed into a concave arc surface. The plurality of drainage holes 1231 are defined at a lower position of the concave arc surface.

The above arrangement also ensures that the plurality of drainage holes 1231 can be located at a lower level than the inner wall surface of the body 120 in the radial direction of the body 120, which is conducive to the flow of the fluid towards the plurality of drainage holes 1231. Therefore, the dewatering quality can be improved to effectively reduce the moisture content of the clothes and improve cleaning performance of the clothes.

In some embodiments of the present disclosure, a fluid flow channel is defined between the lifting rib 200 and the body 120. The drainage holes 1231 being in communication with an inner cavity of the tub 100 through the fluid flow channel. In this way, the fluid in the inner cavity of the tub 100 can flow to the drainage holes 1231 through the fluid flow channel and then be discharged through the drainage hole 1231 to achieve the dewatering. In addition, with the arrangement of the fluid flow channel, the fluid flow channel can guide the flow of the fluid to further improve the drainage efficiency.

In some embodiments, the lifting rib 200 is partially spaced apart from the body 120 to form the fluid flow channel, which facilitates a communication of the drainage hole 1231 with the inner cavity of the tub 100.

It should be noted that by forming the fluid flow channel between the lifting rib 200 and the body 120, it is possible to allow a surface of the lifting rib 200 to be non-porous. In this way, processing steps of the lifting rib 200 can be simplified, and the manufacturing difficulty can be reduced. Further, the abrasion of the inner tub 1000 on the clothes can also be alleviated.

In other examples, the fluid flow channel is defined in the lifting rib 200. The drainage holes 1231 are in communication with the inner cavity of the tub 100 through the fluid flow channel. Such an arrangement can also guide the fluid in the inner cavity of the tub 100 to the drainage holes 1231 to achieve the dewatering.

It should be noted that by forming the fluid flow channel in the lifting rib 200, it is not necessary to form the fluid flow channel between the lifting rib 200 and the body 120, which allows the lifting rib 200 to be tightly attached to the body 120 to improve position stability of the lifting rib 200. Therefore, the cleanliness of the clothes treating can be effectively improved.

In some embodiments, as illustrated in FIG. 1, fluid flow inlets 220 are defined in the lifting rib 200. The plurality of fluid flow inlets 220 are formed as an inlet of the fluid flow channel to communicate the plurality of drainage holes 1231 with the inner cavity of the tub 100.

In some embodiments, each of the plurality of fluid flow inlet 220 defined on the lifting rib 200 may have a small opening. In this way, the plurality of fluid flow inlets 220 may be defined in the lifting rib 200. Further, it is possible for the plurality of fluid flow inlets 220 each having the small opening to prevent the clothes from being scratched by edges of the fluid flow inlets 220 while the dewatering capacity of the inner tub 1000 of the clothes treating apparatus is improved.

It should be noted that by forming the fluid flow channel in the lifting rib 200, a distance between the fluid flow channel and the body 120 can be increased. In this way, during the washing of the clothes, the fluid in the inner tub 1000 can flow out slowly. Thus, the fluid in the inner tub 1000 can be maintained in a high level, which can save an amount of fluid used in the inner tub 1000 to achieve fluid saving. In addition, the above arrangement can also prevent the fluid from flowing between the inner tub 1000 and an outer tub. Thus, dirt and bacteria between the inner tub 1000 and the outer tub cannot flow into the inner tub 1000 through the fluid flow channel. Therefore, healthy cleaning can be realized.

In some embodiments, the lifting rib 200 has a hollow structure. In this way, it is possible to ensure that the lifting rib 200 does not obstruct the flowing of the fluid as the fluid flows through the fluid flow channel towards the plurality of drainage holes 1231, allowing smooth flowing of the fluid to achieve the drainage.

Figure 4:
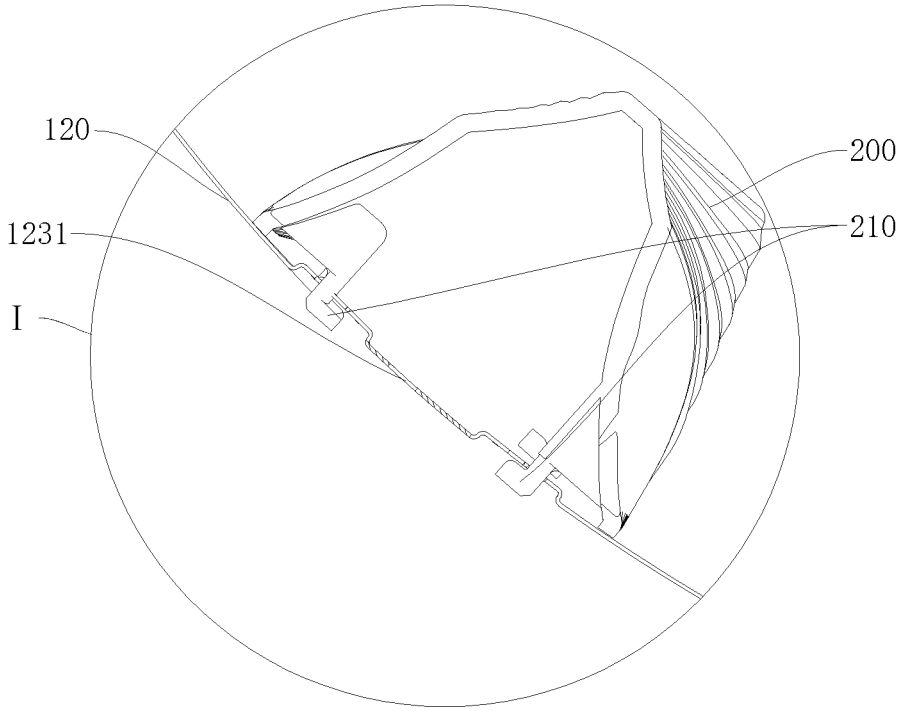
FIG. 4 is an enlarged partial view of region I in FIG. 3.
Figure 7:
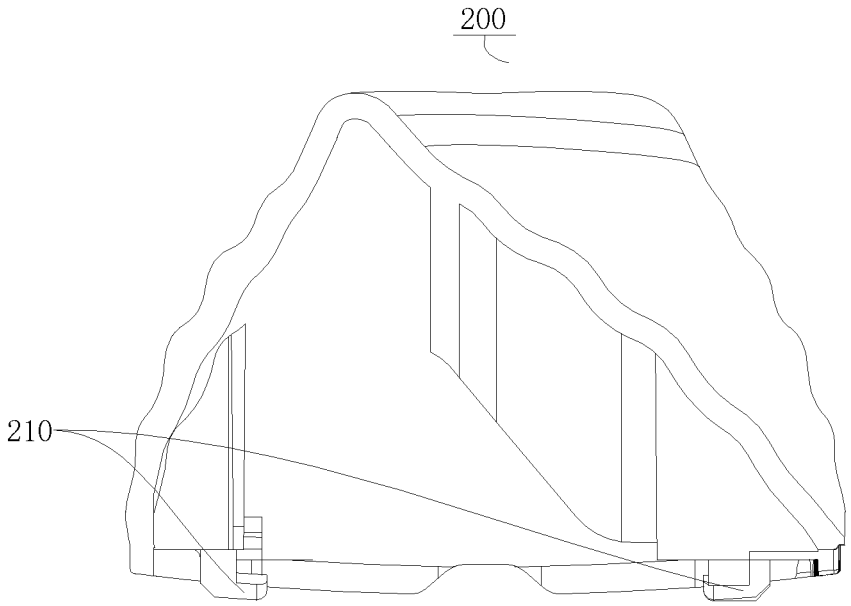
FIG. 7 is a cross-sectional view of a lifting rib according to some other embodiments of the present disclosure.

As illustrated in FIG. 4 or FIG. 7, in some examples, the body 120 has engagement holes, and engagement hooks 210 are disposed at each of two sides of the lifting rib 200. The plurality of engagement hooks 210 are engaged with the plurality of engagement holes in a one-to-one correspondence.

The engagement connection can allow the lifting rib 200 to be fixedly disposed on the body 120, which can not only ensure position stability of the lifting rib 200 relative to the body 120, but also facilitate the engagement between the lifting rib 200 and the body 120. Thus, difficulty of assembly of the inner tub 1000 can be lowered, and the inner tub 1000 has simple structure. In addition, the engagement between the engagement holes and the engagement hooks 210 can allow a detachable connection to be formed between the lifting rib 200 and the body 120. That is, the lifting rib 200 can be completely detached from the body 120 to facilitate replacement or disassembly of the lifting rib 200.

In some other examples, the connection between the lifting rib 200 and the body 120 is not limited to the above-mentioned engagement connection between the engagement hook 210 and the engagement hole, and may also be other connections. For example, first connection holes may be defined at each of two sides of the lifting rib 200, second connection holes matching with the plurality of first connection holes may be defined in the body 120. Each second connection hole is formed into an internally threaded hole. A bolt passes through the first connection hole and is fixedly connected in the second connection hole to realize a detachable connection between the lifting rib 200 and the body 120. In some embodiments, the body 120 has insertion slots, the lifting rib 200 has insertion buckles on each of two sides thereof, and the plurality of insertion buckles are inserted into and engaged with the plurality of insertion slots in a one-to-one correspondence. Such an arrangement can also realize the detachable connection between the lifting rib 200 and the body 120.

In a further embodiment of the present disclosure, the inner tub 1000 may be made of stainless steel. The stainless steel can enhance strength and stiffness of the inner tub 1000 to prolong the service life of the inner tub 1000 for the clothes treating apparatus. In addition, the stainless steel can enhance visual aesthetics of the inner tub 1000 due to its metallic texture.

The inner tub 1000 for the clothes treating apparatus according to embodiments of the present disclosure is described below with reference to the accompanying drawings of the specification.

Figure 5:
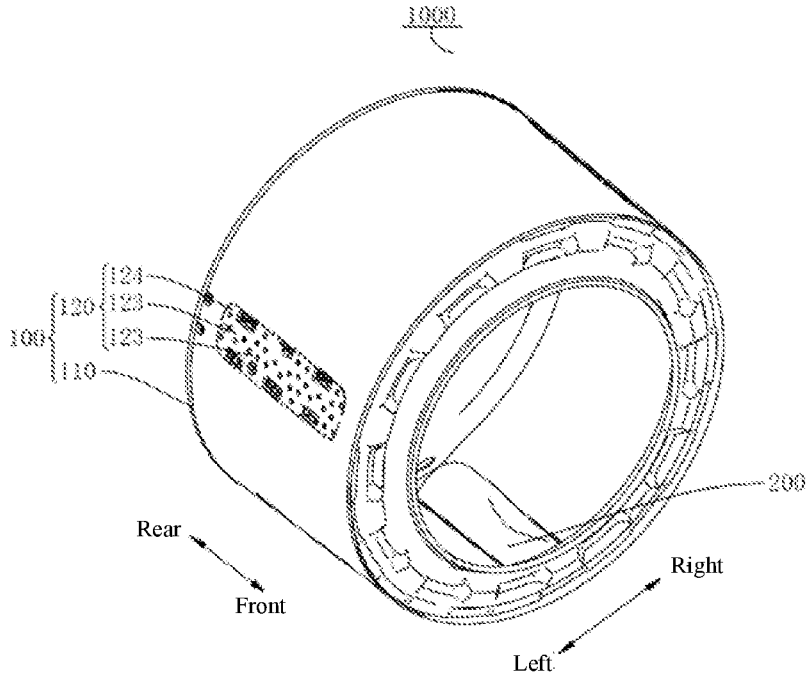
FIG. 5 is a schematic perspective structural view of an inner tub according to some other embodiments of the present disclosure.

As illustrated in FIG. 5, the inner tub 1000 for the clothes treating apparatus according to embodiments of the present disclosure includes a tub 100 and a lifting rib 200.

The tub 100 includes a bottom 110 and a body 120. The body 120 has a drainage region 124. The drainage region 124 is mainly designed to facilitate an arrangement of the drainage holes 1231, which in turn facilitates drainage of the inner tub 1000 in subsequent clothes treating.

The lifting rib 200 is disposed on an inner side of the body 120 and covers the drainage region 124. Rows of drainage holes 123 are defined in the drainage region 124 covered with the lifting rib 200. Each row of drainage holes 123 includes drainage holes 1231. For at least two adjacent rows of the plurality of rows of drainage holes 123, the plurality of drainage holes 1231 of one row of drainage holes 123 are staggered with the respective plurality of drainage holes 1231 of the other row of drainage holes 123 in an axial direction of the body 120.

The plurality of drainage holes 1231 can realize a communication between the inner tub 1000 and an external flow path to ensure that a fluid in the inner tub 1000 can be smoothly discharged through the plurality of drainage holes 1231 to achieve the purpose of clothes treating. In addition, the plurality of drainage holes 1231 cooperate with each other to perform drainage simultaneously, which improves the drainage efficiency of the inner tub 1000. In addition, the washing water and dirt can be completely discharged, and thus the clothes treating capacity of the inner tub 1000 can be improved.

In addition, in the present disclosure, the drainage region 124 is covered with the lifting rib 200. That is, the plurality of drainage holes 1231 are covered with the lifting rib 200. Therefore, on the one hand, aesthetics of the inner tub 1000 can be improved by preventing the drainage region 124 from being directly observed by the user; and on the other hand, the plurality of drainage holes 1231 can be ensured to be not in direct contact with the clothes in the clothes treating process. Thus, it is possible to avoid the abrasion of the clothes by the edges of the plurality of drainage holes 1231 to effectively avoid the abrasion of the clothes by the plurality of drainage holes in the related art. Therefore, an abrasion rate of the clothes can be greatly reduced, and thus the user experience can be improved.

It should be noted that through arranging the lifting rib 200 on the inner side of the body 120, during the clothes washing of the clothes treating apparatus, the lifting rib 200 can drive the clothes to rotate as the tub 100 rotates. In this way, on the one hand, a level of the clothes can be increased by the lifting rib 200, and the clothes at a predetermined level fall down due to gravity. In this way, the clothes can be thrown and rolled in an up-down direction for clothes treating. On the other hand, a contact area between the clothes and the inner tub 1000 can be increased by the lifting rib 200. Thus, it is possible to generate rubbing effect by mutual friction between the clothes close to the lifting rib 200 and the lifting rib 200. Therefore, clothes treating capacity of the inner tub 1000 can be improved to enhance user experience.

That is, in the present disclosure, the lifting rib 200 can not only improve the clothes treating capacity of the inner tub 1000, but also improve the aesthetics of the inner tub 1000. Also, it is possible to avoid the abrasion of the clothes by edges of the plurality of drainage holes 1231. Further, with the above arrangement, it is not necessary to additionally provide other structural members for covering the plurality of drainage holes 1231. Thus, the production costs of the inner tub 1000 can be reduced while the inner tub 1000 has a simple structure.

With the inner tub 1000 for the clothes treating apparatus according to the embodiments of the present disclosure, the plurality of rows of drainage holes 123 are defined in the drainage region 124. The plurality of rows of drainage holes 123 can ensure that a great number of drainage holes 1231 can be defined in the drainage region 124. The great number of drainage holes 1231 cooperate with each other to perform the drainage. Thus, the drainage efficiency of the inner tub 1000 can be improved. In addition, for at least two adjacent rows of the plurality of rows of drainage holes 123, the plurality of drainage holes 1231 of one row of drainage holes are staggered with the respective plurality of drainage holes 1231 of the other row of drainage holes 123 in an axial direction of the body, which means that in the drainage region 124, every two rows of the plurality of rows of drainage holes 123 are adjacent to each other. In every two adjacent rows of drainage holes 123, for at least two rows of the plurality of rows of drainage holes 123, the plurality of drainage holes 1231 in one row of drainage holes 123 are staggered the respective plurality of drainage holes 1231 in the other row of drainage holes 123 in the axial direction of the body 120.

In this regard, the expression "staggered in the axial direction" herein should be understood as that spacings between each of two adjacent drainage holes 1231 in two adjacent rows of drainage holes 123 and the bottom 110 in the axial direction of the body 120 are different from each other.

In this way, the plurality of drainage holes 1231 in the drainage region 124 can be located at different positions of the body 120 in both the axial direction and the circumferential direction. With such an arrangement, the plurality of drainage holes 1231 cooperate with each other to simultaneously discharge the fluid located at different positions of the body 120. Thus, the drainage of the inner tub 1000 is more convenient, and the drainage efficiency can also be improved. In this way, the washing water and dirt in the inner tub 1000 can be smoothly and completely discharged to improve the drainage effect.

It should be understood that, compared with an inner tub for a clothes treating apparatus in the related art, for the inner tub 1000 for the clothes treating apparatus of the present disclosure, the plurality of drainage holes 1231 axially staggered with each other in the body 120 is defined in the drainage region 124, and the plurality of drainage holes 1231 staggered with each other cooperate with each other. Thus, the drainage efficiency of the inner tub 1000 can be increased while the drainage performance of the inner tub 1000 is improved. In addition, in the present disclosure, the plurality of drainage holes 1231 are defined in the part covered with the lifting rib 200. Therefore, it is possible to ensure that the clothes would not be brought into direct contact with the clothes the plurality of drainage holes 1231 in the clothes treating process of the clothes treating apparatus, which can prevent the clothes from being snagged or scratched by the plurality of drainage holes 1231. Thus, the user experience is improved.

In the description of the present disclosure, unless otherwise specified, "plurality" means two or more.

In some embodiments, for any two adjacent rows of the plurality of rows of drainage holes 123, the plurality of drainage holes 1231 of one row of drainage holes 123 are staggered with the respective plurality of drainage holes 1231 of the other row of drainage holes 123 in the axial direction of the body 120. That is, the plurality of rows of drainage holes 123 are defined in the drainage region 124. Every two rows of the plurality of rows of drainage holes 123 are arranged adjacent to each other. For any two adjacent rows of the plurality of rows of drainage holes 123, the plurality of drainage holes 1231 of one row of drainage holes 123 are staggered with the respective plurality of drainage holes 1231 of the other row of drainage holes 123 in the axial direction of the body 120, which allows the plurality of drainage holes 1231 in the drainage region 124 to be staggered with each other in the axial direction of the body 120. In this way, the plurality of drainage holes 1231 can cooperate with each other to simultaneously discharge the fluid located at different positions of the body 120. Thus, the drainage efficiency of the inner tub 1000 can be improved.

Figure 6:
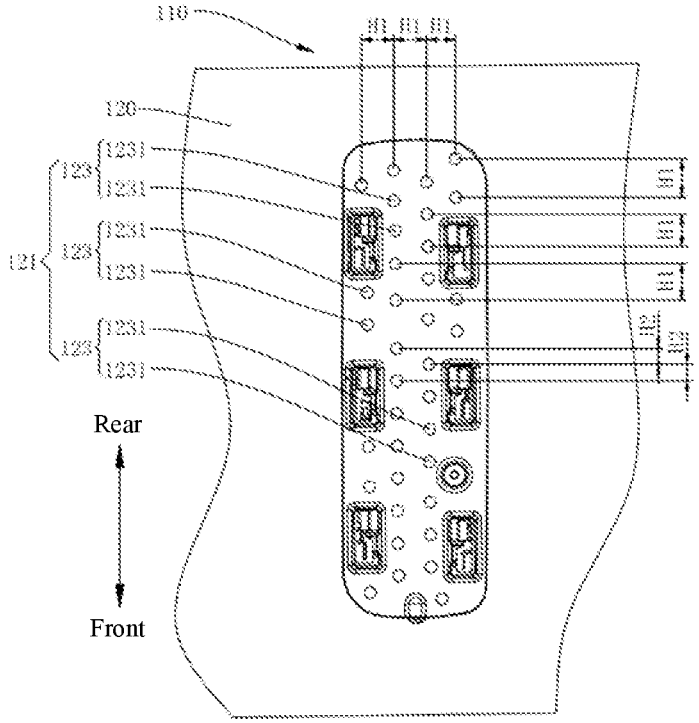
FIG. 6 is a schematic partial structural view of an inner tub according to yet some other embodiments of the present disclosure.

In some embodiments, as illustrated in FIG. 6, in each row of drainage holes 123, a spacing between two adjacent drainage holes 1231 in the axial direction of the body 120 is H1. In this way, it is possible to allow the plurality of drainage holes 1231 in each row of drainage holes 123 to be arranged at intervals in the axial direction of the body 120 to discharge the fluid located at different positions in the axial direction of the body 120.

It should be noted that, the spacing between two adjacent drainage holes 1231 in the same row of drainage holes 123 being H1 indicates that no other fixing member or structural members are disposed in a region where the same row of drainage holes 123 are defined. For example, with reference to FIG. 5 and FIG. 6, when another structural member is disposed in a region of the leftmost row of drainage holes 123 in the drainage region 124, two adjacent drainage holes 1231 need to avoid this structural member. Therefore, it is likely for the spacing between two adjacent drainage holes 1231 in the axial direction of the body 120 to be greater than H1. That is, for the same row of drainage holes 123, when no other structural member is disposed between two adjacent drainage holes 1231, the spacing between the two adjacent drainage holes 1231 in the axial direction of the body 120 is H1; and when another structural member is disposed between two adjacent drainage holes 1231, the spacing between the two adjacent drainage holes 1231 in the axial direction of the body 120 is adjusted accordingly based on a size of the structural member, and the spacing between two adjacent drainage holes 1231 in the axial direction of the body 120 is not limited to H1.

In some embodiments, as illustrated in FIG. 6, for two adjacent rows of drainage holes 123, a spacing between one of the plurality of drainage holes 1231 in one row of the drainage holes 123 and a drainage hole 1231, adjacent to the one drainage hole 1231, in the other row of drainage holes 123 is H2, where H1 is twice as great as H2. That is, for two adjacent rows of drainage holes 123, a spacing between one of the plurality of drainage holes 1231 in one row of the drainage holes 123 and a drainage hole 1231, adjacent to the one drainage hole 1231, in the other row of drainage holes 12 is smaller than the spacing between two adjacent drainage holes 1231 in the same drainage holes 123 in the axial direction of the body 120. In this way, for two adjacent rows of drainage holes 123, the plurality of drainage holes 1231 in one row of drainage holes 123 can be staggered with the respective plurality of drainage holes 1231 in the other row of drainage holes 123 in the axial direction of the body 120. Thus, the drainage efficiency of the inner tub 1000 can be increased while the drainage effect is improved.

In some embodiments, for two adjacent rows of drainage holes 123, when the spacing between one of the plurality of drainage holes 1231 in one row of drainage holes 123 and a drainage hole 1231, adjacent to the one drainage hole 1231, in the other row of drainage holes 123 is H1, i.e., when the spacing between one of the plurality of drainage holes 1231 in one row of drainage holes 123 and the drainage hole 1231, adjacent to the one drainage hole 1231, in the other row of drainage holes 123 in the axial direction of the body 120 is equal to the spacing between two adjacent drainage holes 1231 in the same row of drainage holes 123 in the axial direction of the body 120, it is likely that the drainage hole 1231 in the one row of drainage holes 123 may directly face the drainage hole 1231, adjacent to the one drainage hole 1231 in the other row of drainage holes 123 in the axial direction of the body 120. In this case, when the fluid in the body 120 partially flows to a region between two adjacent drainage holes 1231 in the one row of drainage holes 123, the fluid cannot be discharged from the drainage holes 1231, which may reduce the drainage efficiency of the inner tub 1000.

However, in the present disclosure, for the two adjacent rows of drainage holes 123, the spacing between one of the plurality of drainage holes 1231 in one row of drainage holes 123 and the drainage hole 1231, adjacent to the one drainage hole 1231 in the other row of drainage holes 123 in the axial direction of the body 120 is set smaller than the spacing between two adjacent drainage holes 1231 in the same row of drainage holes 123 in the axial direction of the body 120. In this way, when the fluid in the body 120 partially flows to the region between two adjacent drainage holes 1231 in the one row of drainage holes 123, the fluid may continue flowing into one of the drainage holes 1231 in the other row of drainage holes 123, and then is discharged smoothly through the one of the drainage holes 1231 in the other row of drainage holes 123. Thus, the drainage efficiency of the inner tub 1000 can be improved.

In some embodiments, a spacing between two adjacent rows of drainage holes 123 in the circumferential direction of the body 120 is equal to a spacing between two adjacent drainage holes 1231 in each row of drainage holes 123 in the axial direction of the body 120. It should be understood that the spacing between two adjacent rows of drainage holes 123 in the circumferential direction of the body 120 is H1 (as illustrated in FIG. 6), which allows the two adjacent rows of drainage holes 123 to be arranged at intervals in the circumferential direction of the body 120. Therefore, it can be ensured that the plurality of rows of drainage holes 123 cooperate with each other to discharge the fluid at different positions in the circumferential direction of the body 120. Thus, the drainage efficiency is improved.

In some embodiments of the present disclosure, the fluid flow channel (not shown) is defined on the lifting rib 200. The drainage holes 1231 are in communication with the inner cavity of the tub 100 through the fluid flow channel. The fluid flow channel is configured to avoid the fluid flowing towards the drainage holes 1231 and guide the flowing of the fluid to ensure that the fluid in the inner cavity of the tub 100 can flow smoothly to the drainage holes 1231 and be discharged through the drainage holes 1231. Thus, the dewatering can be achieved.

In a further example, the lifting rib 200 may be partially spaced apart from the body 120 to allow the fluid flow channel to be formed between the lifting rib 200 and the body 120. In this way, a communication of the drainage hole 1231 with the inner cavity of the tub 100 can be easily achieved.

In some embodiments, a fluid flowing-through opening is defined in a lower part of at least one side wall of the lifting rib 200. When the lifting rib 200 is disposed on the inner side of the body 120, the fluid flowing-through opening is located between the side wall of the lifting rib 200 and the body 120 to form the fluid flow channel between the lifting rib 200 and the body 120. That is, the fluid flow channel is defined by the fluid flowing-through opening together with the body 120 to allow the drainage holes 1231 to be communication with the inner cavity of the tub 100.

In some embodiments, fluid flowing-through openings are provided. The plurality of fluid flowing-through openings are arranged at intervals in the lower part of the side wall of the lifting rib 200. The plurality of fluid flowing-through openings can cooperate with each other to increase a fluid flowing-through area of the fluid flow channel. Thus, it is possible to ensure that the fluid in the inner cavity of the tub 100 can quickly flow into the fluid flow channel, and then is quickly discharged through the drainage holes 1231. Thus, the drainage efficiency can be improved. In addition, with arranging the plurality of fluid flowing-through openings at intervals, by using side walls of the lifting rib 200 between two adjacent fluid flowing-through openings, the lifting rib 200 can be connected to the inner side of the body 120. In this way, a fixed connection between the lifting rib 200 and the tub 100 can be achieved.

In a further example, the plurality of fluid flowing-through openings are arranged at intervals in a length direction of the lifting rib 200, and there is fluid flowing-through openings defined at each of two opposite sides of the lifting rib 200 in a width direction thereof. Through forming the plurality of fluid flowing-through openings in the length direction of the lifting rib 200, the plurality of fluid flowing-through openings can cooperate with each other to guide the fluid located at different positions in the length direction of the body 120 to the drainage holes 1231. Thus, it is possible to ensure that the fluid at different positions in the length direction of the body 120 is guided to the plurality of drainage holes 1231 and discharged through the plurality of drainage holes 1231 simultaneously. Therefore, the drainage efficiency can be further improved.

In addition, through forming the plurality of fluid flowing-through openings at each of two opposite sides of the lifting rib 200 in the width direction thereof, the plurality of fluid flowing-through openings can cooperate with each other to guide the fluid in the inner cavity of the body 120 located at both sides of the lifting rib 200 in the width direction to the plurality of drainage holes 1231. It should also be understood that through forming the plurality of fluid flowing-through openings at each of two opposite sides of the lifting rib 200 in the width direction thereof, the plurality of fluid flowing-through openings can cooperate with each other to guide the fluid located at different positions in the circumferential direction of the body 120 to the plurality of drainage holes 1231 simultaneously and discharge the fluid through the plurality of drainage holes 1231. That is, it is possible to ensure that the fluid at different positions in the circumferential direction of the body 120 is discharged simultaneously. Thus, the drainage efficiency is further improved.

As can be seen from the above, in the present disclosure, by forming the plurality of fluid flowing-through openings arranged at intervals in the length direction of the lifting rib 200, the fluid at different positions in the axial direction of the body 120 can be discharged simultaneously. In addition, by forming the plurality of fluid flowing-through openings arranged at each of two opposite sides of the lifting rib 200 in the width direction thereof, the fluid at different positions on the body 120 in the circumferential direction thereof can be discharged simultaneously. Therefore, it is possible to ensure that the fluid at different positions on the body 120 in the axial direction and the circumferential direction thereof can be discharged simultaneously. Thus, the drainage efficiency of the inner tub 1000 can be maximized, and in particular, the moisture content of the clothes can be minimized when the dewatering is performed by the inner tub 1000. Thus, the user experience can be improved.

In some embodiments, each of the plurality of fluid flowing-through openings is located at a position corresponding to at least one drainage hole 1231. That is, the fluid flow channel formed between the lifting rib 200 and the body 120 is located at a position corresponding to the at least one drainage hole 1231. It should be understood that the term "at a position corresponding to" means that the fluid flow channel is directly opposite to the at least one drainage hole 1231 in the axial direction of the body 120. In this way, it is possible to allow the fluid in the inner cavity of the body 120 to be directly guided to the at least one drainage hole 1231 by the fluid flow channel. Therefore, the drainage efficiency of the inner tub 1000 can be improved.

It should be noted that in the present disclosure, through forming the fluid flow channel between the lifting rib 200 and the body 120, the surface of the lifting rib 200 can be designed to have a non-porous structure. Thus, the processing steps of the lifting rib 200 can be simplified, and the manufacturing difficulty is reduced. Further, the abrasion of the inner tub 1000 on the clothes can also be alleviated.

In some embodiments of the present disclosure, drainage regions 124 are provided. The plurality of drainage regions 124 are arranged at intervals in the circumferential direction of the body 120. Since each drainage region 124 has rows of drainage holes 123 and each row of drainage holes 123 includes drainage holes 1231, such an arrangement can increase the amount of drainage holes 1231 in the body 120. Thus, the drainage capacity of the inner tub 1000 can be increased, and the drainage efficiency can also be improved.

In addition, in the present disclosure, the plurality of drainage regions 124 are arranged at intervals in the circumferential direction of the body 120. Thus, it is possible to allow the fluid located at several positions in the inner tub 1000 to be discharged through the plurality of drainage holes 1231 simultaneously. Thus, the drainage efficiency is further improved. In a further embodiment, during the dewatering of the inner tub 1000, the plurality of drainage holes 1231 cooperate with each other, which can greatly improve the dewatering quality to reduce the moisture content of the clothes.

In some embodiments, the body 120 has three drainage regions 124. The three drainage regions 124 are evenly distributed on the body 120. The three drainage regions 124 cooperate with each other to discharge all of the fluid in the inner tub 1000 to achieve the dewatering, and thus the dewatering efficiency is improved.

In some other examples, the present disclosure is not limited to the above three drainage regions 124. Some embodiments may provide more drainage regions 124 based on the actual drainage needs and the volume of the inner tub 1000. For example, four, five, or more drainage regions 124 may be provided.

It should be noted that an increase in an amount of the drainage regions 124 may result in a decrease in the structural strength of the body 120. Therefore, providing the three drainage regions 124 can effectively improve the structural strength of the body 120 while increasing the drainage efficiency, which can prolong the service life of the inner tub 1000.

In some embodiments, lifting ribs 200 are disposed on the body 120. On the one hand, the plurality of lifting ribs 200 are configured to cooperate with the plurality of drainage regions 124 on the body 120. Each lifting rib 200 covers one drainage region 124 on the body 120 to ensure that each drainage region 124 has the lifting rib 200, which can avoid the abrasion of the clothes by edges of the plurality of drainage holes 1231. Thus, the clothes abrasion can be effectively alleviated.

In addition, through arranging the plurality of lifting ribs 200, the plurality of lifting ribs 200 can cooperate with each other to further increase the contact area between the inner tub 1000 and the clothes. Thus, the cleanliness of the treated clothes can be improved.

In some further examples, three lifting ribs 200 are disposed on the body 120. The three lifting ribs 200 are evenly distributed on the inner wall of the inner tub 1000 to cover the three drainage regions 124, respectively. When the clothes treating apparatus is in operation, the lifting ribs 200 may rotate along with the inner tub 1000. During the rotation of the lifting ribs 200 from a lower level to a higher level, the lifting ribs 200 may lift the clothes. As the lifting ribs 200 continues rotating, the clothes are separated from the lifting ribs 200 due to gravity, and fall down freely on the tumbling fluid flow or other laundries. Therefore, the clothes are washed, and the washing performance of the clothes treating apparatus is improved.

In some other examples, the present disclosure is not limited to the above three lifting ribs 200. Four, five, or more lifting ribs 200 may be provided, as long as the amount of lifting ribs 200 can correspond to the amount of the drainage regions 124 and the lifting ribs 200 can effectively cover the plurality of drainage holes 1231.

In some embodiments of the present disclosure, an inner peripheral wall of the body 120 has a rubbing region 250. The rubbing region can provide the clothes with greater frictional resistance during the clothes treating of the inner tub 1000 to allow the body 120 to have a rubbing function itself. Therefore, the clothes can be treated more cleanly to improve the user experience.

In some embodiments, the rubbing region and the drainage region 124 are arranged in the circumferential direction of the body 120. It should also be understood that when the body 120 has drainage regions 124, the rubbing region is located between two adjacent drainage regions 124. Since the body 120 has a larger area in the circumferential direction, such an arrangement can maximize areas of the rubbing regions and drainage regions 124. Thus, on the one hand, the cleaning performance of the inner tub 1000 can be improved, and on the other hand, the drainage efficiency is improved.

In some embodiments, the rubbing region and the drainage region 124 are alternately arranged in the circumferential direction of the body 120. That is, there is no drainage region 124 at a position on the body 120 where the rubbing region is located. Accordingly, there is no rubbing region at a position on the body 120 where the drainage region 124 is located. In the present disclosure, since the lifting rib 200 needs to cover the drainage region 124, the above arrangement can allow the rubbing region and the lifting rib 200 to be alternately arranged in the circumferential direction of the body 120 to prevent the lifting rib 200 from shielding the rubbing region. In this way, the rubbing region can maximize frictional resistance applied to the clothes to improve a quality of clothes cleaning. Also, the above arrangement can also avoid the arrangement of the plurality of drainage holes 1231 in the rubbing region. Thus, a layout of the plurality of drainage holes 1231 is simpler and easier.

Also, by alternately arranging the rubbing region and the lifting rib 200 in the circumferential direction of the body 120, the rubbing region and the lifting rib 200 can cooperate with each other to rub against the clothes, which can further enhance the clothes treating capacity of the inner tub 1000.

In some embodiments, the rubbing region has rubbing protrusions. The plurality of rubbing protrusions are arranged at intervals in the circumferential direction of the body 120. The plurality of rubbing protrusions may be understood as protrusions disposed on the rubbing region. In the clothes treating process, the plurality of rubbing protrusions can be in contact with and rub against the clothes to provide the rubbing. Thus, the clothes treating capacity of the inner tub 1000 can be enhanced. Meanwhile, the plurality of rubbing protrusions can cooperate with each other to increase the contact area between the rubbing region and the clothes, and therefore the clothes treating capacity of the inner tub 1000 can be further improved.

In some embodiments, the rubbing region is a non-porous region. That is, no hole is defined in the rubbing region. Since the rubbing region is in direct contact with the clothes during the clothes treating process of the inner tub 1000, designing the rubbing region into the non-porous region can avoid abrasion and scratching on the clothes by the rubbing region, i.e., avoid the abrasion of the clothes by the inner tub 1000 during the clothes treating. Thus, the user experience can be improved.

In some embodiments, flow guide channels are each defined between two adjacent rubbing protrusions. An end of each of at least some of the plurality of flow guide channels directly face the respective drainage region 124. In a further example, the plurality of rubbing protrusions can be arranged at interval and extend in a same direction. In this way, the flow guide channel can be defined between two adjacent rubbing protrusions. For example, the rubbing protrusion is formed into an elongated shape. A length of each rubbing protrusion extends in the circumferential direction of the body 120. In this way, the flow guide channel can be formed between the two adjacent rubbing protrusions. In addition, it can be ensured that the end of each of some of the fluid guide channels directly faces the respective drainage region 124. During the drainage, the flow guide channels can guide flowing of the fluid in the body 120 to ensure that the fluid can flow in a predetermined direction. In addition, since the end of each of some of the fluid guide channels directly faces the respective drainage region 124, the flow channels can guide the fluid to the drainage region 124. In this case, the fluid is discharged through the plurality of drainage holes 1231 in the drainage region 124 to achieve the dewatering. Thus, the drainage efficiency is improved.

In some embodiments, the end of each of some of the fluid guide channels directly faces the drainage holes 1231. The flow guide channels can directly guide the fluid to the plurality of drainage holes 1231 to further improve the drainage efficiency.

As can be seen from the above, in the present disclosure, the flow guide channel is formed by the structure (the rubbing protrusion) on the body 120 itself. In this way, it is unnecessary to provide other flow guide members, which further simplifies the structure of the inner tub 1000/thus, the structure of the inner tub 1000 is simple.

In a further embodiment of the present disclosure, the inner tub 1000 may be made of stainless steel. The stainless steel can enhance strength and stiffness of the inner tub 1000 to prolong the service life of the inner tub 1000 for the clothes treating apparatus. In addition, the stainless steel can enhance visual aesthetics of the inner tub 1000 due to its metallic texture together with the rubbing protrusions on the inner tub 1000.

A clothes treating apparatus according to embodiments of the present disclosure is described below in conjunction with the accompanying drawings.

The clothes treating apparatus according to the embodiments of the present disclosure includes an outer tub and an inner tub 1000.

The inner tub 1000 is the above-mentioned inner tub 1000 for the clothes treating apparatus, and thus the description of a structure of the inner tub 1000 in detail will be omitted herein. The inner tub 1000 is rotatably disposed in the outer tub.

With the clothes treating apparatus according to the embodiments of the present disclosure, with the inner tub 1000 as described above, the inner tub 1000 can to drive the clothes to rotate during a rotation relative to the outer tub to achieve the clothes treating. Further, it is possible to ensures that the clothes are in no contact with the plurality of drainage holes 1231 during the rotation to avoid scratching or abrasion of the clothes, etc. In addition, the plurality of drainage holes 1231 staggered with each other in the body 120 in the axial direction thereof is defined on the above-mentioned inner tub 1000, which can further enhance the drainage performance of the clothes treating apparatus to improve the drainage efficiency to achieve the dewatering. Further, it is possible to reduce the moisture content of the clothes, and thus the user experience is improved.

It should be noted that, the outer tub is disposed on the outer side of the inner tub 1000. Therefore, although the plurality of drainage holes 1231 in the present disclosure is arranged in the normally open state, when the fluid is filled between the inner tub 1000 and the outer tub, the fluid in the inner tub 1000 will not be discharged through the plurality of drainage holes 1231 during the cleaning of the clothes by the clothes treating apparatus, In this case, the fluid in the inner tub 1000 can wash the clothes. When washing of the clothes is finished and dewatering is required, a fluid outlet of the outer tub is opened to enable the fluid between the inner tub 1000 and the outer tub to be discharged. Thus, it is possible to ensure that the fluid in the inner tub 1000 can be discharged through the drainage holes 1231 to achieve the dewatering.

The clothes treating apparatus in the present disclosure may be a drum washing machine. That is, the inner tub 1000 in the present disclosure may be applied to a drum washing machine. The clothes treating apparatus may also be applied to a conventional dryer or pulsator washing machine in the market. When the inner tub 1000 is applied to a dryer, dewatering efficiency of the dryer can be improved. When the inner tub 1000 is applied to the pulsator washing machine or the drum washing machine, washing and dewatering efficiency of the pulsator washing machine or the drum washing machine can be improved.

In the description of the present disclosure, it should be noted that, unless otherwise clearly specified and limited, terms such as "installed", "connected", "coupled", and the like should be understood in a broad sense. For example, it may be a fixed connection or a detachable connection or connection as one piece; mechanical connection or electrical connection; direct connection or indirect connection through an intermediate; internal communication of two components. In some embodiments, the specific meaning of the above-mentioned terms in the present disclosure can be understood according to specific circumstances.

FIG. 6 illustrates four rows of drainage holes 123 for an illustrative purpose. However, some embodiments can be applied to other embodiments in which two, three, five, or more rows of drainage holes 123, which also fall within the scope of the present disclosure.

Figure 8:
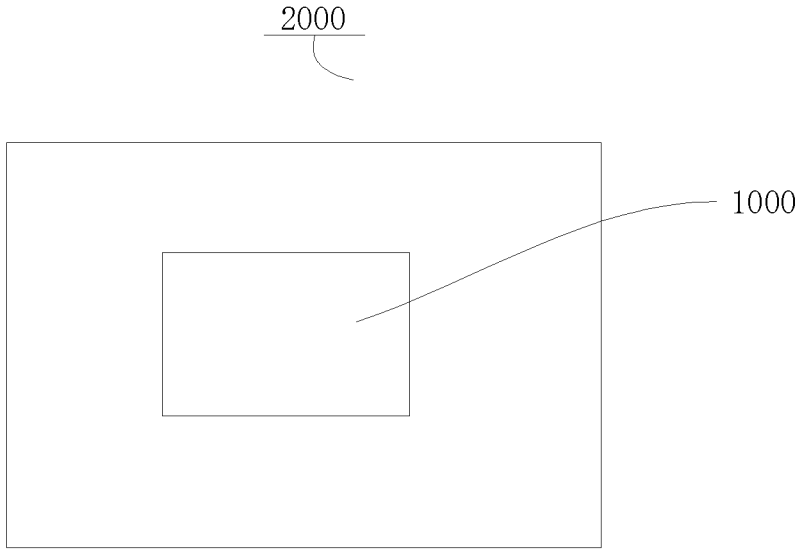
FIG. 8 is a schematic block diagram of a clothes treating apparatus according to some embodiments of the present disclosure.

As shown in FIG. 8, other compositions of the inner tub 1000 for the clothes treating apparatus 2000 and the clothes treating apparatus according to the embodiments of the present disclosure, e.g., a rotation process and a control process of the inner tub 1000, the description thereof in detail will be omitted herein.

In the description of this specification, descriptions with reference to the terms "an embodiment", "an example", etc., mean that specific features, structure, materials or characteristics described in conjunction with the embodiment or example are included in at least one embodiment or example of the present disclosure. In this specification, the schematic representations of the above terms do not necessarily refer to the same embodiment or example. Moreover, the described specific features, structures, materials, or characteristics may be combined in any one or more embodiments or examples in a suitable manner.

What is claimed is:

1. An inner tub for a clothes treating apparatus, the inner tub comprising:

a tub comprising a bottom and a body, the body having a drainage region; and a lifting rib disposed on an inner side of the body and covering the drainage region, wherein a plurality of drainage holes are defined in a part of the body covered with the lifting rib, the plurality of drainage holes being in a normally open state to communicate an inner side of the tub with an outer side of the tub, and wherein a remaining part of the body other than the part of the body covered with the lifting rib has a closed structure; wherein an inner peripheral wall of the body has a rubbing region, the rubbing region being a non-porous region, the rubbing region and the drainage region being arranged in a circumferential direction of the body, and the rubbing region having a plurality of rubbing protrusions arranged at intervals in the circumferential direction of the body;

a plurality of flow guide channels are each defined between two adjacent rubbing protrusions of the plurality of rubbing protrusions, an end of each of at least some of the plurality of flow guide channels directly facing the respective drainage region;

a plurality of fluid flowing-through openings are defined in a lower part of at least one side wall of the lifting rib, a fluid flow channel being defined by the plurality of fluid flowing-through openings together with the body; and at least one of the plurality of fluid flowing-through openings is located at a position corresponding to at least one of the plurality of drainage holes;

the plurality of drainage holes comprises a plurality of rows of drainage holes, for at least two adjacent rows of the plurality of rows of drainage holes, the plurality of drainage holes of a first row of drainage holes are staggered with the respective plurality of drainage holes of a second row of drainage holes in an axial direction of the body, wherein an inner wall surface of the body has a plurality of recesses recessed towards an outside of the tub, the plurality of drainage holes being defined in bottom walls of the plurality of recesses.

2. The inner tub for the clothes treating apparatus according to claim 1, wherein:

the body comprises a plurality of first walls and a plurality of second walls, the plurality of first walls and the plurality of second walls being alternately arranged and connected to each other in a circumferential direction;

the plurality of drainage holes are defined in at least one of the plurality of first walls;

wherein the lifting rib comprises a plurality of lifting ribs are disposed on the plurality of first walls in a one-to-one correspondence to cover all of the plurality of drainage holes; and each of the plurality of second walls has a non-porous structure.

3. The inner tub for the clothes treating apparatus according to claim 1, wherein the plurality of rows of drainage holes being arranged at intervals in a circumferential direction of the body.

4. The inner tub for the clothes treating apparatus according to claim 3, wherein:

for the plurality of rows of drainage holes, a spacing between any two adjacent rows of drainage holes is equal to a spacing between any other two adjacent rows of drainage holes; and for each row of the plurality of rows of drainage holes, the plurality of drainage holes are arranged at intervals in an axial direction or the circumferential direction of the body.

5. The inner tub for the clothes treating apparatus according to claim 3, wherein:

the lifting rib extends in an axial direction of the tub;

wherein the lifting rib comprises a plurality of lifting ribs are disposed on the body, each of the plurality of lifting ribs covering one row of drainage holes on the body.

6. The inner tub for the clothes treating apparatus according to claim 1, wherein an inner wall surface of the body has a concave arc surface, the plurality of drainage holes being defined in the concave arc surface.

7. The inner tub for the clothes treating apparatus according to claim 1, wherein:

the lifting rib has a hollow structure, the body has a plurality of engagement holes, and the lifting rib has a plurality of engagement hooks disposed at each of two sides of the lifting rib, the plurality of engagement hooks being engaged with the plurality of engagement holes in a one-to-one correspondence.

8. An inner tub for a clothes treating apparatus, the inner tub comprising:

a tub comprising a bottom and a body, the body having a drainage region; and a lifting rib disposed on an inner side of the body and covering the drainage region, wherein:

a plurality of rows of drainage holes are defined in the drainage region covered with the lifting rib;

each row of the plurality of rows of drainage holes comprises a plurality of drainage holes;

for at least two adjacent rows of the plurality of rows of drainage holes, the plurality of drainage holes of a first row of drainage holes are staggered with the respective plurality of drainage holes of a second row of drainage holes in an axial direction of the body;

an inner peripheral wall of the body has a rubbing region, the rubbing region being a non-porous region, the rubbing region and the drainage region being arranged in a circumferential direction of the body, and the rubbing region having a plurality of rubbing protrusions arranged at intervals in the circumferential direction of the body;

a plurality of flow guide channels are each defined between two adjacent rubbing protrusions of the plurality of rubbing protrusions, an end of each of at least some of the plurality of flow guide channels directly facing the respective drainage region;

a plurality of fluid flowing-through openings are defined in a lower part of at least one side wall of the lifting rib, a fluid flow channel being defined by the plurality of fluid flowing-through openings together with the body; and at least one of the plurality of fluid flowing-through openings is located at a position corresponding to at least one of the plurality of drainage holes, wherein an inner wall surface of the body has a plurality of recesses recessed towards an outside of the tub, the plurality of drainage holes being defined in bottom walls of the plurality of recesses.

9. The inner tub for the clothes treating apparatus according to claim 8, wherein for any two adjacent rows of the plurality of rows of drainage holes, the plurality of drainage holes of the first row of drainage holes are staggered with the respective plurality of drainage holes of the second row of drainage holes in the axial direction of the body.

10. The inner tub for the clothes treating apparatus according to claim 8, wherein:

a spacing between two adjacent drainage holes of same row in the axial direction of the body is H1;

first row of drainage holes and second row of drainage holes are staggered in the axial direction of the body, and staggered distance is H2; and H1 is twice as great as H2.

11. The inner tub for the clothes treating apparatus according to claim 8, wherein a spacing between the two adjacent rows of the plurality of rows of drainage holes in a circumferential direction of the body is equal to a spacing between two adjacent drainage holes in each row of the plurality of rows of drainage holes in the axial direction of the body.

12. The inner tub for the clothes treating apparatus according to claim 8, wherein a plurality of drainage regions are provided, the plurality of drainage regions being arranged at intervals in a circumferential direction of the body.

13. A clothes treating apparatus, comprising:

an outer tub; and the inner tub for the clothes treating apparatus according to claim 8, wherein the inner tub is rotatably disposed in the outer tub.

14. The clothes treating apparatus according to claim 13, wherein:

the body comprises a plurality of first walls and a plurality of second walls, the plurality of first walls and the plurality of second walls being alternately arranged and connected to each other in a circumferential direction;

the plurality of drainage holes are defined in at least one of the plurality of first walls;

wherein the lifting rib comprises a plurality of lifting ribs are disposed on the plurality of first walls in a one-to-one correspondence to cover all of the plurality of drainage holes; and each of the plurality of second walls has a non-porous structure.

15. The clothes treating apparatus according to claim 13, wherein the plurality of rows of drainage holes being arranged at intervals in a circumferential direction of the body.

16. The clothes treating apparatus according to claim 15, wherein:

for the plurality of rows of drainage holes, a spacing between any two adjacent rows of drainage holes is equal to a spacing between any other two adjacent rows of drainage holes; and for each row of the plurality of rows of drainage holes, the plurality of drainage holes are arranged at intervals in an axial direction or the circumferential direction of the body.

17. The clothes treating apparatus according to claim 15, wherein:

the lifting rib extends in an axial direction of a tub;

wherein the lifting rib comprises a plurality of lifting ribs are disposed on the body, each of the plurality of lifting ribs covering one row of drainage holes on the body.

* * * * *